United States Patent [19]

Empl et al.

[11] Patent Number: 5,048,719

[45] Date of Patent: Sep. 17, 1991

[54] APPARATUS FOR STORING, HEATING AND DISPENSING PORTIONED FOOD ITEMS

[75] Inventors: Franz Empl, Heppenheim; Herbert Mink, Lautertal, both of Fed. Rep. of Germany

[73] Assignee: Nestec S.A., Vevey, Switzerland

[21] Appl. No.: 345,673

[22] Filed: Apr. 28, 1989

[30] Foreign Application Priority Data

May 10, 1988 [DE] Fed. Rep. of Germany ..... 3816028

[51] Int. Cl.[5] ..... B65D 83/00; G07F 11/72

[52] U.S. Cl. ..... 221/119; 221/130; 221/133; 221/150 HC; 221/153; 221/253; 198/952; 426/243; 219/10.55 A; 219/10.55 R; 99/386; 99/443 C

[58] Field of Search ..... 221/129, 130, 150 HC, 221/150 A, 153, 76, 77, 82, 83, 253, 87, 119, 123, 151-153, 124, 133, 218, 154, 194, 206, 247, 230, 150 R, 248; 414/272, 276, 278, 285; 198/952; 426/241, 243, 248; 126/21 A; 219/10.55 A, 10.55 R; 432/120, 121; 99/373, 386, 443 R, 443 C, DIG. 10

[56] References Cited

U.S. PATENT DOCUMENTS

| | | | |
|---|---|---|---|
| 3,190,493 | 6/1965 | Johnson et al. | 221/194 X |
| 3,397,817 | 8/1968 | Smith | 219/10.55 R |
| 3,614,365 | 10/1971 | Lane | 219/10.55 A |
| 3,974,353 | 8/1976 | Goltsos | 219/10.55 A |
| 4,108,333 | 9/1978 | Falk et al. | 221/130 |
| 4,171,667 | 10/1979 | Miller et al. | 221/254 X |
| 4,363,955 | 12/1982 | Gauthier et al. | 99/386 X |
| 4,687,119 | 9/1987 | Juillet | 221/150 HC |
| 4,848,591 | 7/1989 | Wada | 221/130 X |
| 4,927,051 | 5/1990 | Falk et al. | 221/153 X |
| 4,949,629 | 8/1990 | Leary et al. | 99/386 |

*Primary Examiner*—Michael S. Huppert
*Assistant Examiner*—Kenneth DeRosa
*Attorney, Agent, or Firm*—Vogt & O'Donnell

[57] ABSTRACT

An apparatus for storing, heating and dispensing portioned foods items has a cooled storage unit for storing portioned food items, a cooking unit for heating the portioned food items, a transport lift unit for transferring the food items to be heated from the storage unit to the cooking unit and an output unit for transferring heated food items from the cooking unit to a dispensing station for dispensing. The storage unit includes a plurality of conveyor belts upon which the portioned food items are stored and which transport the food items to the transport lift unit. Each of the lift transport unit, the cooking unit and the output unit includes a conveyor for transferring the food items.

39 Claims, 5 Drawing Sheets

APPARATUS FOR STORING, HEATING AND DISPENSING PORTIONED FOOD ITEMS

BACKGROUND OF THE INVENTION

This invention relates to an apparatus for storing, heating and automatically dispensing portioned foods.

An automatic dispenser for dispensing heated portioned foods is described and illustrated in DE-OS 34 12 899. In this known automatic dispenser, a storage unit arranged in a cool zone is formed by a turntable with several vertically adjacent storage planes. The foods stored on the turntable are brought into their respective transfer positions by rotation of the turntable.

One disadvantage of the dispenser disclosed in DE-OS 34 12 899 is that, because the automatic dispenser is based on a turntable, its housing extends to a considerable depth, thus restricting the possibilities for installing the dispenser in relatively confined spaces, such as corridors. Another disadvantage is that the turntable can only be occupied by one food on either side because, otherwise, problems would be involved in transferring the food stored on the inside to the transfer station through the absence of a conveyor. Another drawback is that there is only one turntable which rotates as a whole. Thus, the entire weight of the storage turntable, including the foods, has to be moved to bring the food in question into the transfer position. In addition, during the transport of a certain food into the transfer position by rotation of the turntable, other foods already in the dispensing position are removed from the transfer position which, again, involves a considerable detour and considerable transport energy.

SUMMARY OF THE INVENTION

The present invention provides an automatic dispenser which has a compact construction and which provides for the transport of portioned food items from a cooled storage unit to a cooking unit via a transport lift unit quickly and easily.

In the dispenser according to the invention, the storage unit contains a plurality of endless conveyors arranged one above the other, each having a horizontally disposed conveying surface, which provide for portion-by-portion advance of portioned food items on conveyor belts towards the transport lift unit, which also has a conveyor having a horizontally disposed conveying surface, so that there are no unused transport paths. Only those portioned food items which are situated on a particular storage unit conveyor belt are advanced to the transport lift unit. Thus, in the automatic dispenser according to the invention, a number of foods and, in addition, a number of different types of food can be stored on the storage unit conveyor belts, and the control of these conveyor belts to obtain a particular desired portioned food item, particularly in view of the presence of several food types, is relatively simple.

Particularly useful in the present dispenser is a cooking unit comprised of a combination of a microwave oven and an infrared heater, more particularly a light heater (approximately 1.3 micrometers). This combination provides for excellent heating of the portioned food items and is particularly suitable for the heating of so-called fast foods packed in cooking film, such as hamburgers, hot dogs, toasted sandwiches and pizzas which are quasi-wrapped in film, which are problematical to reheat because of the moisture produced by the microwave heating on the one hand and the need for crispiness on the other hand.

The combination of the microwave oven and infrared heater provides a cooking unit which, through the use of microwaves, rapidly generates deep heat and also a certain moisture in the food, on the one hand, and, on the other hand the infrared radiation, with a certain depth effect, effectively counteracts moisture formation and produces a fresh and juicy but crispy food which fulfills the consumer's expectations and is therefore tasty in a very short heating time.

In addition, the invention provides an output unit which includes a conveyor, which also has a horizontally disposed conveying surface, for transporting the portioned food items heated by the cooking unit to an output dispensing station. The cooking unit, therefore, also provides for conveying the portioned food items while being heated from the transport unit to the output unit and thus contains a conveyor having a horizontally disposed conveying surface for transporting the foods through the oven and advantageously is embodied as a tunnel oven.

Examples of particular embodiments of the invention are described in detail in the following:

DETAILED DESCRIPTION OF THE DRAWINGS

Figure 9:
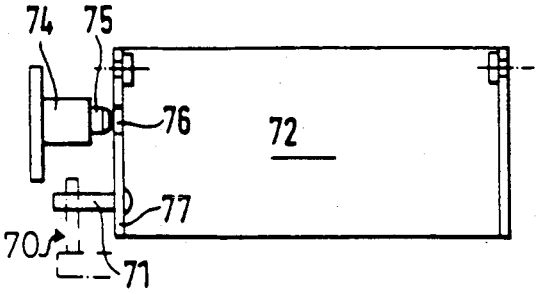
FIG. 9 is a view from inside of an output flap of the dispenser.
Figure 3:
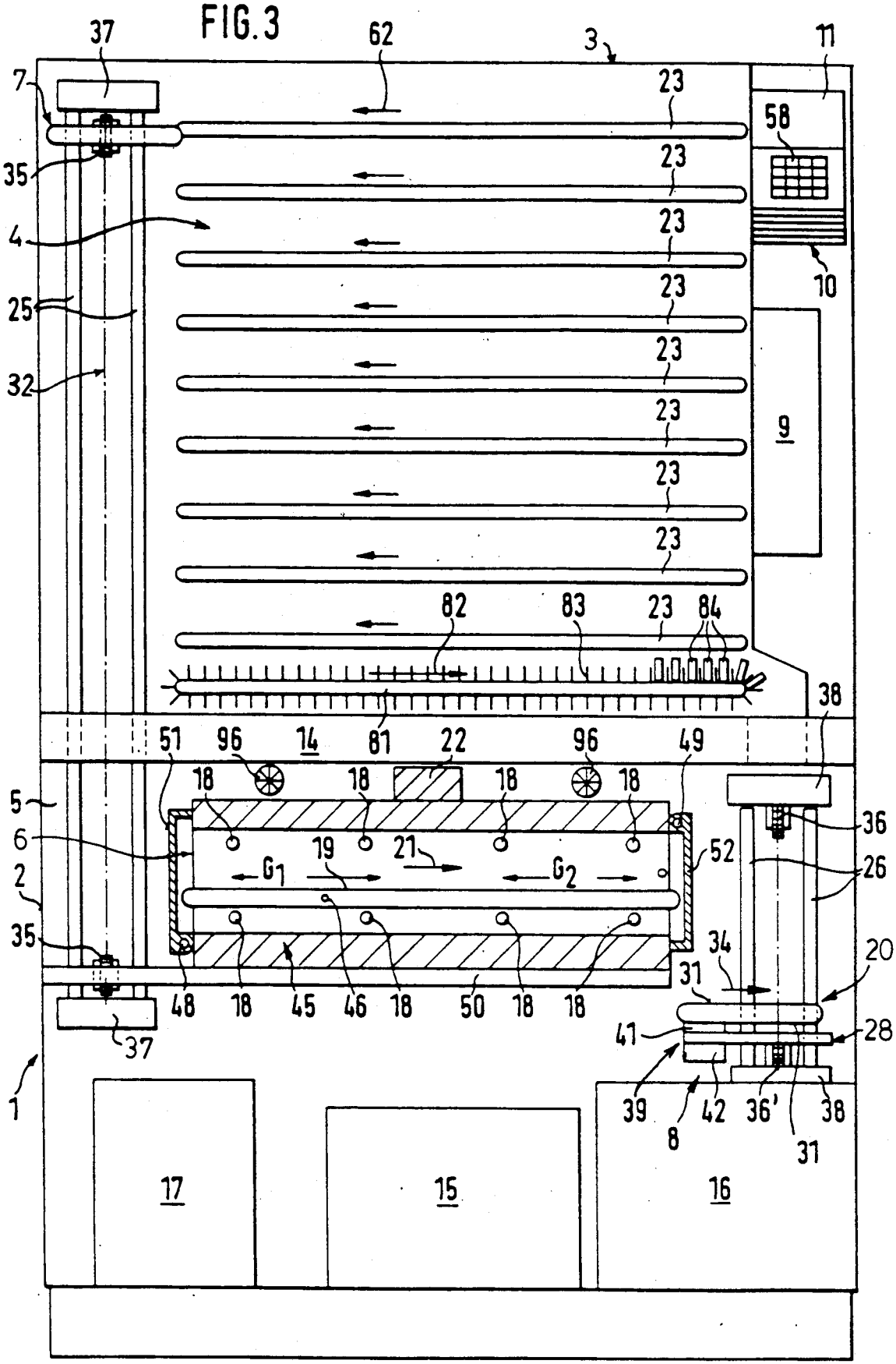
FIG. 3 is a front elevation of internal operative elements of the dispenser.

As can best be seen from FIG. 3, the principal parts of the automatic dispenser, globally denoted by [the] reference numeral 1, are a housing 2 with an upper compartment 3 serving as a cool compartment, in which a storage unit 4 is arranged, a lower compartment 5, in which a cooking unit 6 is arranged, a transport lift unit 7 active between the storage unit 4 and the cooking unit 6, and an output unit 8 following the cooking unit 6, including a dispensing station 69 as illustrated, for example, in FIG. 9. A coin box 9, preferably incorporating a coin changer, which controls the authorized removal of a portioned food item, and an electronic control system 10, preferably incorporating a loudspeaker 11 which the control system controls for conveying instructions to the consumer, also are provided.

Figure 2:
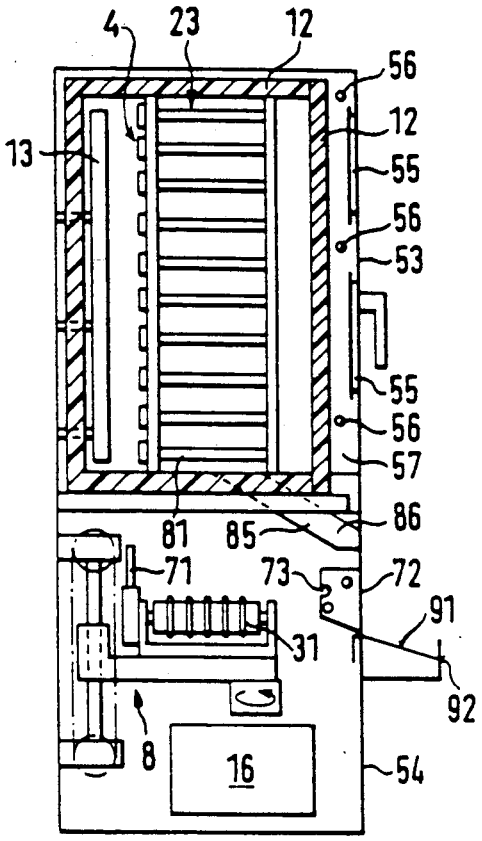
FIG. 2 is a section through the dispenser on the line II—II in FIG. 1.

As illustrated in FIG. 2, upper housing compartment 3 is lined with insulation 12. A cooler 13, or evaporator, is disposed on the back of the upper housing compartment 3 for the controlled maintenance of a cooling temperature in the upper housing compartment 3.

Again, as shown in FIG. 3, in addition to the cooking unit 6 and the output unit 8, beneath the insulated partition, or dividing wall 14, there is a main connection 15, illustrated at the bottom centre of the lower housing compartment 5, a cooling unit 16, illustrated at the right of main connection 15, and an electrical power supply 17, illustrated at the left of main connection 15, for the cooking unit 6 which, in the illustrated embodiment, is embodied in a tunnel oven 45 disposed on a hollow frame 50, or it may be disposed on a supporting wall.

As illustrated in FIG. 3, cooking unit 6 is comprised of a microwave oven, having a magnetron denoted by reference numeral 22, and an infrared heater with eight infrared tubes 18. The infrared tubes preferably are finger tubes, having an electrical connection on only one side, which extend horizontally and transversely of the throughput direction 21 above and below the throughput plane 19 of the conveying surface of conveyor 46 of the cooking unit 6.

As further illustrated in FIG. 3, storage unit 4 consists of nine vertically adjacent, substantially horizontal conveyor belts 23, each having its own drive motor, which are mounted on the housing 2 and may extend along the back or front of the automatic dispenser 1. As illustrated, each storage unit conveyor belt has a horizontal conveying surface and is comprised of a plurality of adjacent belts, as shown, in particular, in FIG. 4, circulating about end rollers.

As illustrated in FIG. 3 and as illustrated in more detail in FIGS. 4 and 5 and FIGS. 7 and 8, transport lift unit 7 and the output unit 8, which also includes a conveyor transport lift unit 24, each comprise a conveyor carriage 27, 28, respectively, which is displaceable in a pair of vertical guide rails 25, 26, respectively, and with which is associated an endless conveyor belt 29, 31, respectively, corresponding in principle to the conveyor belts 23, circulating around end rollers. Conveyor belt 31 of the output unit 8 is driven only in the direction indicated by the arrow 34. Conveyor belt 29 of the transport lift unit 7 is driven, as required, in both directions. Each of the conveyor carriages 27, 28 are vertically displaceable by a vertically circulating conveyor chain 32, 33, respectively, circulating around sprocket wheels 35, 36 which are mounted on cross-members 37, 38, respectively, connecting the guide rods 25, 26, respectively, to the housing 2 by means of split bearings.

A special feature is associated with the conveyor transport lift unit carriage 28 and conveyor belt 31 of output unit 8 in the form of a pivoting mechanism, globally denoted by reference numeral 39 which enables the conveyor belt 31 to be pivoted horizontally through 90°, as described hereinafter. The pivoting mechanism comprises a pivot bearing 41 and a pivoting motor 42 mounted on the conveyor carriage 28.

Associated with the tunnel oven 45 is a horizontal conveyor belt 46 in the form of a chain conveyor with several chains which circulate at a distance from one another and which extend in the central throughput zone between the entrance and exit of the tunnel oven 45 and which may project slightly beyond the ends thereof and which are driven in the conveying direction indicated by arrow 21.

Figure 6:
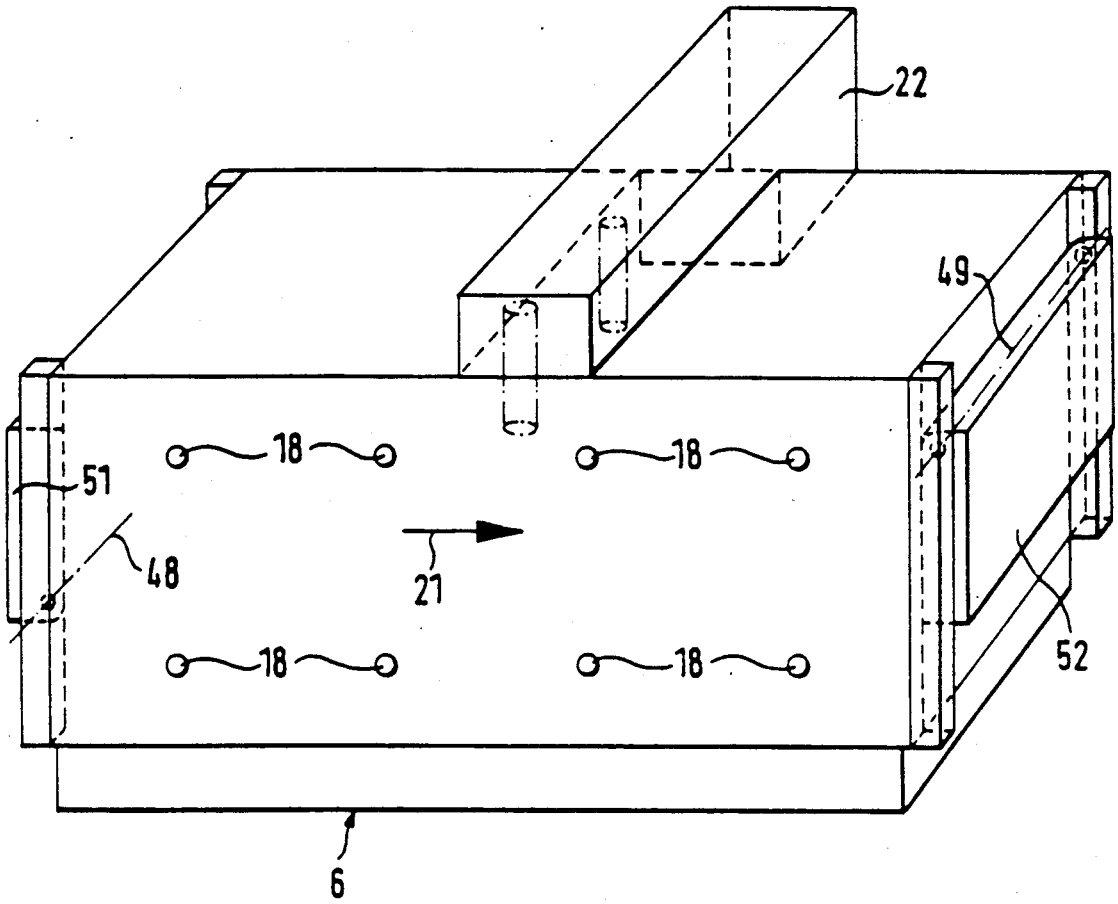
FIG. 6 is a perspective view of the cooking unit.
Figure 7:
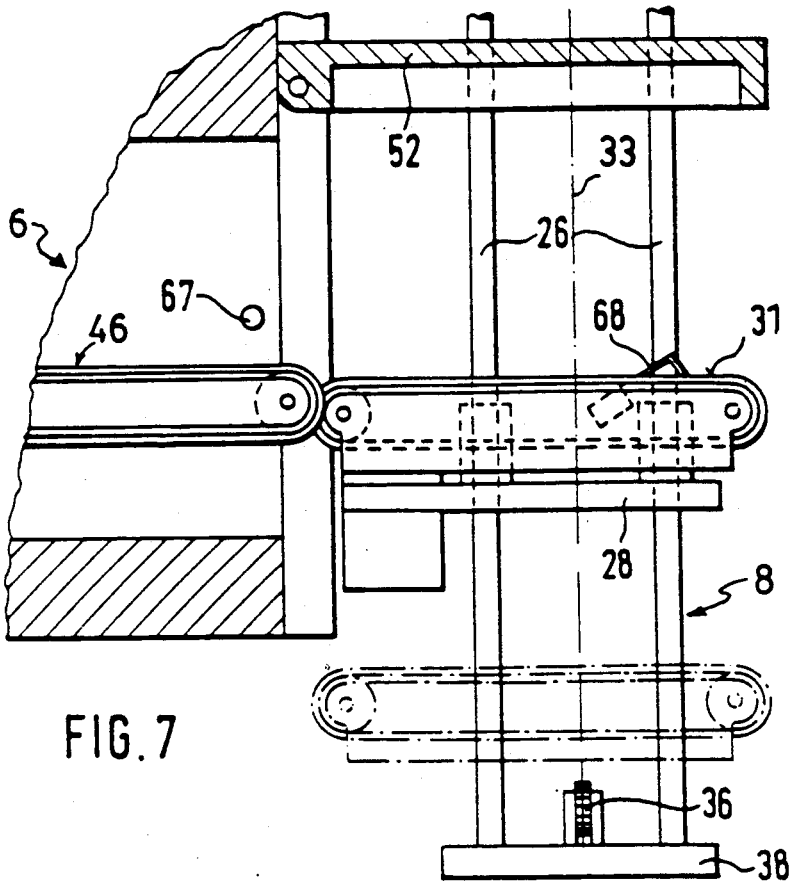
FIG. 7 illustrates transfer of portioned food items between the cooking unit and the output unit conveyor transport lift unit conveyor of the dispenser.
Figure 8:
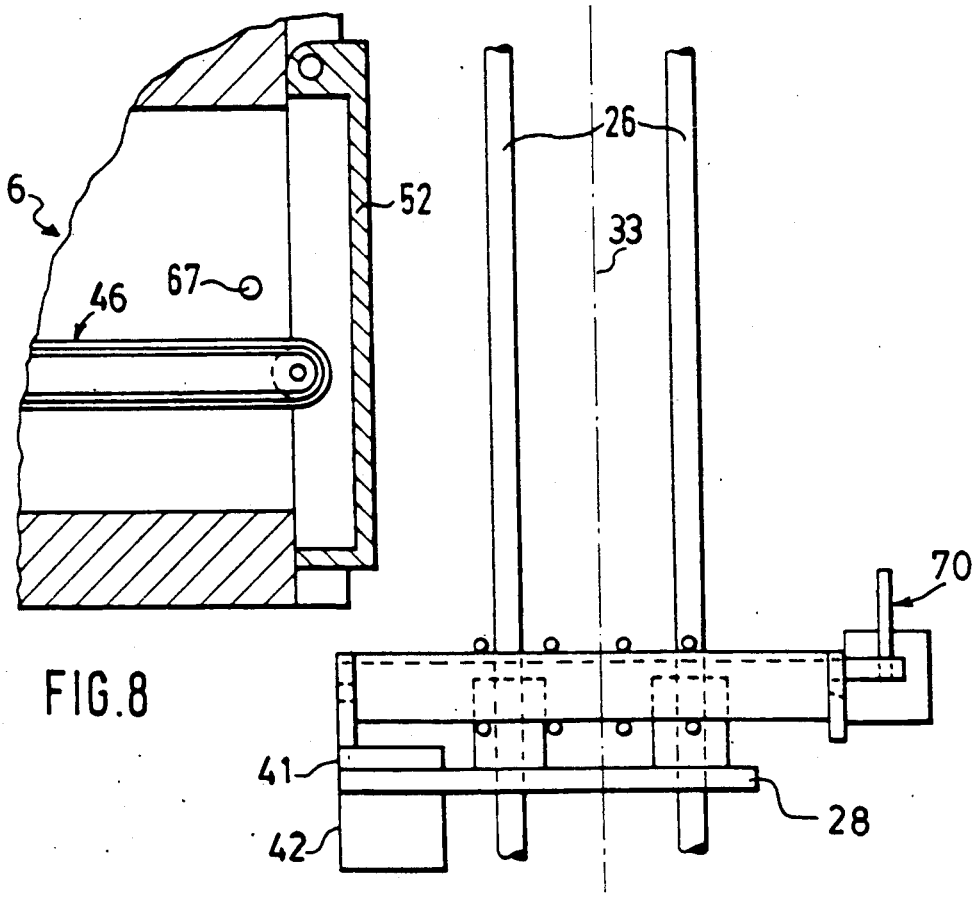
FIG. 8 illustrates the output unit conveyor of FIG. 7 in an output position.

As also shown in FIG. 6, as well as in FIG. 3, associated, with the entrance and exit openings at the input and output ends, respectively, of the tunnel oven 45 cooking unit are flaps 51, 52, respectively, which are pivotal about a horizontal axis 48, 49, respectively. The pivot axis of entry flap 51 is situated in the lower region and the pivot axis 49 of exit flap 52 is situated in the upper region of the associated flap so that the entry flap 51 is opened by a downwardly directed pivoting movement and so that the exit flap 52 is opened by an upwardly directed pivoting movement. This is advantageous because the opening and closing movements of flaps 51, 52 are adapted, as further described hereinafter, to the vertical movements of the conveyor carriages 27, 28 so that the carriages can directly follow the flaps 51, 52, enabling the conveying time to be considerably lengthened. The flaps 51, 52 are internally hollow so that they are able to cover an overhang of the conveyor belt 46.

Figure 1:
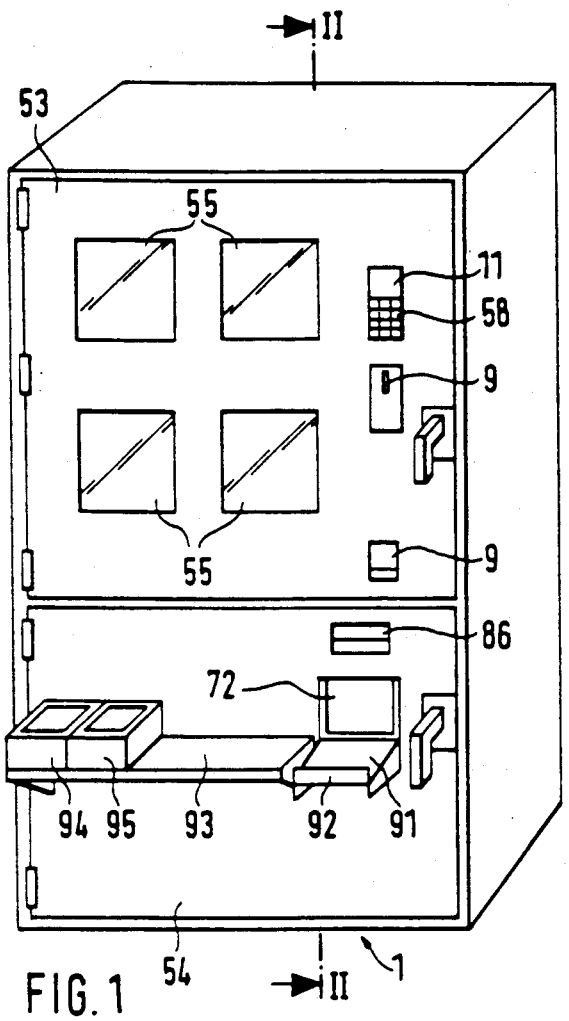
FIG. 1 is a perspective view of a dispenser according to the invention.

As illustrated in FIG. 1, each of upper and lower housing compartments 3, 5 can be opened and closed by doors 53, 54, respectively. As illustrated, doors 53, 54 are pivotal about lateral vertical axes and are accessible, as required, by means of handles. In the embodiment illustrated in FIG. 1, the upper housing door 53 comprises four windows 55 through the panes of which the types of food which can be dispensed, such as hamburgers, pizzas, hot dogs and toasted sandwiches, are pictorially displayed. The windows 55 are illuminated from inside by lamps or fluorescent tubes 56 arranged in a gap or empty space 57 between the housing door 53 and the associated insulation 12. The illuminated windows 55 are a conspicuous indication, on the one hand, of the automatic dispenser 1 itself and, on the other hand, of the foods which can be dispensed.

The foods are accommodated in the storage unit 4 in the form of portions wrapped in cooking film which are arranged one behind the other on the conveyor belts 23 in the transport direction 62. As illustrated in FIG. 2, there are nine conveyor belts 23 and in a case of dispensing four different foods at least two conveyor belts 23 may be combined into a group for dispensing one type of food.

A time switch or displacement switch (not shown) is associated with each conveyor belt 23 and, during use of the dispenser after a first conveyor belt 23 has traveled a certain distance, for example half the length or the entire length of its available conveying surface, releases a signal to switch off that conveyor belt and switch on a next (second) conveyor belt 23 of the same group of food and so on. After the portions on the last conveyor belt of a group have been cleared, the first conveyor belt 23 of the group is switched back on again. This ensures that the last portions to be loaded by a service person are the last to be taken (first in, first out).

The dispensing of a food is determined or initiated by the selection of the food type by depression of a pushbutton 58 on the upper right-hand side of the automatic dispenser such as 1, in the upper housing door 53, as illustrated in FIG. 1. The subsequent insertion of a coin switches on the tunnel oven 45 and the selection of the appropriate conveyor belt 23 for transport to transport lift unit 7.

Figure 4:
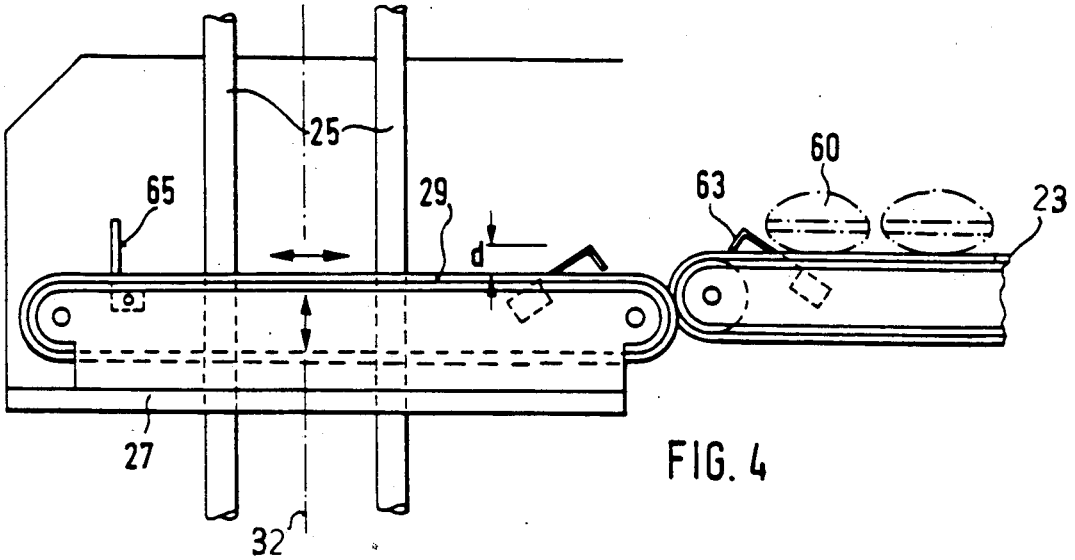
FIG. 4 illustrates transfer of portioned food items between a conveyor of the storage unit and a transport lift unit of the dispenser.

By depression of the corresponding pushbutton 58 and by insertion of a coin, the corresponding conveyor belt 23 of the associated group is driven in the transport direction 62 until the first portion 60 of the row situated on the particular conveyor belt 23 strikes a conveyor belt switch 63, as shown in FIG. 4, and, by actuation thereof, brings the conveyor belt 23 to a stop. At the same time, the switch 63 activates the delivery of the carriage 27 which provides the conveying surface of conveyor belt 29 in a slightly lower position than the conveying surface of the particular conveyor belt 23 so that there is a slight vertical difference "d" between the conveying surface of the activated conveyor belt 23 [in question] and the conveyor belt 29, as also shown in FIG. 4. The corresponding storage and lift conveyor belts 23, 29, respectively, are then driven in the conveying direction 62 so that the first illustrated portioned food item denoted by reference numeral 60 in FIG. 4 passes onto the conveying surface of conveyor belt 29 and is conveyed thereon to the conveyor belt switch 65 which it actuates by contact, switching off the conveyor belt 29 and switching on the drive of the conveyor carriage 27 for movement into a transfer position between the transport lift unit 7 and the tunnel oven 45.

Figure 5:
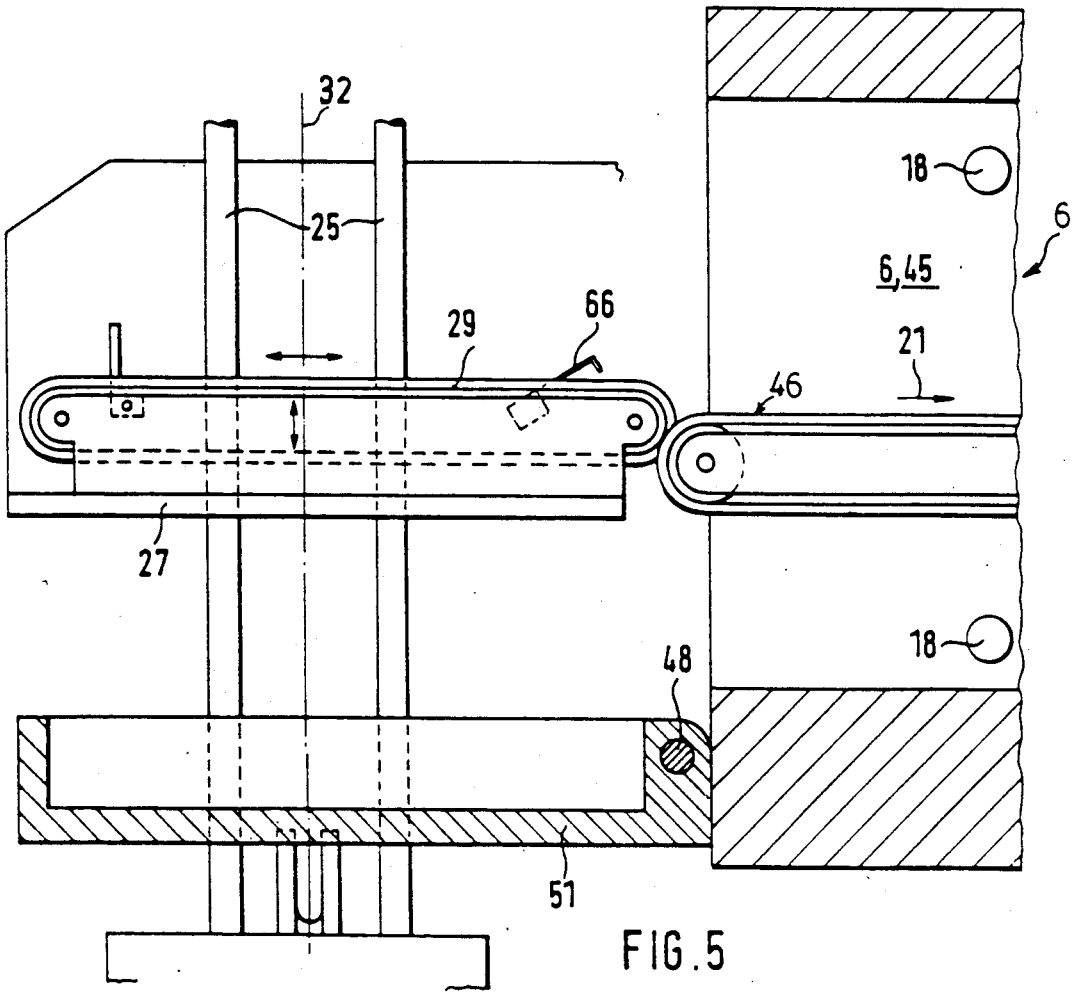
FIG. 5 illustrates a transfer position between transport lift unit of FIG. 4 and the cooking unit of the dispenser.

Just before the conveyor carriage 27 moves into the vicinity of the entry flap 51, the drive of flap 51 (not shown) is activated by a switch (not shown), so that flap 51 is pivoted upwards through about 90° in the same direction of movement as the conveyor carriage 27 so that the carriage 27 can move into the transfer position shown in FIG. 5, preferably into a position so that the conveying surface of conveyor belt 29 is higher by the vertical difference "d" than the conveying surface of conveyor belt 46 of the tunnel oven 45. The conveying surface of conveyor belt 29 of the transfer lift unit 7 is then driven towards the tunnel oven 45 so that the portioned food item situated thereon actuates a second conveyor belt switch 66, as illustrated at the right end thereof, and switches on the conveyor belt 46, unless conveyor belt 46 has already been switched on by a preceding portioned food item. The portioned food item thus enters the tunnel oven 45 switched on by selection of the food (pushbutton 58) or by insertion of a coin, passing into the range of the microwaves and infrared rays (light radiation in the near range).

In an embodiment in which the tunnel oven 45 is approximately 600 mm long, the time taken for one or more of the portioned food items to pass through the tunnel oven 45 is about two minutes. During this time, the portioned food item, or a plurality of items, is heated by the microwaves and the infrared radiation. The moisture produced by the microwaves in the portioned food item, or items, is compensated for by the infrared radiation, a factor to be taken into account in this regard being that infrared radiation has a certain depth effect down to 15–25 mm. At the same time, the portioned food item, or items, in the tunnel oven 45 is heated by the heat produced, being cooked crispily, in particular on the outside, in particular by the infrared radiation, while retaining a certain inner moisture. Under the depth effect of the infrared radiation, the portion is also internally heated, the adverse effect of heating solely by microwaves, namely a doughy or pulpy texture, being counteracted or compensated so that a tasty, crispy and appetizing heated portioned food item is obtained.

The four pairs 18 of tubes present in tunnel oven 45 are preferably divided up into a first group $G_1$ and a second group $G_2$ of which the first group $G_1$ is controlled in a temperature range from about 280° C. to 310° C. 280° C. on, 310° C. off) while the second group $G_2$ produces a substantially constant temperature of approximately 360° C. The quality of heating is further improved by the lower temperature in the first half of the tunnel oven 45.

To cool the housing compartment 5 accommodating the cooking unit 6, at least one deaerator 96 is provided in an opening in the rear housing wall. Fresh air is let in preferably through openings in the base.

At the end of the tunnel oven 45, the portion actuates a switch, more especially a photocell 67, which switches on the opening drive of the output flap 52. The conveyor belt 31 of the output unit 8 is situated in the position shown in FIG. 7 beneath the output flap 52 and extends parallel to the tunnel oven 45. As the output flap 52 opens, the upward drive (chain 36) of the output unit 8 is actuated and the drive of the conveyor belt 31 is switched on. The portion thus passes onto the conveyor belt 31 and actuates a switch 68 which gradually or immediately stops the conveyor belt 31, switches on the downward drive of the carriage 28 for movement of the conveyor belt 31 into the lower position, switches on the pivoting motor 42 and switches the conveyor belt 31 on again, optionally after a certain time lag.

During the pivoting of the conveyor belt 31 through 90°, an output flap 72, of dispensing station 69 (FIGS. 2 and 9), covering an opening in and being pivotal about an upper horizontal axis in the lower housing door 54, is pivoted outwards and thus opened by a pressure rod 70 fixed to the conveyor belt 31, so that the heated portioned food item is dispensed through the output opening present during its transport on the conveyor belt 31. The pressure rod 70 strikes a horizontal arm 71 on the output flap 72. The output flap 72 is preferably locked in its closed position by a bolt 73 and is only actuated to be unlocked during the output of a portioned food item. This is done by means of an electromagnet 74 (FIG. 9) which is mounted on the housing 2, or may be mounted on other parts thereof, and of which the armature 75 is held electrically in a recess 76 in an inwardly angled web 77 of the output flap 72. Preferably, the electromagnet 74 is also actuated to release the bolt 73 when conveyor belt switch 68 is activated. Immediately after the output of the heated portioned food item through the output opening, the drive of the conveyor belt 31 is switched off again and pivoted back through 90° into the lower position shown in FIG. 7.

Trouble-free transfer from conveyor belt to conveyor belt (23, 29, 46, 31) is guaranteed on the one hand by a downward step formed by the vertical difference "d" and, on the other hand, by the fact that the belts interengage comb-like with one another or overlap one another. On the conveyor belts 23 in particular, the portioned food items are also detached from one another by the step. The overlap can be obtained by staggering the belts or chains or by a different number (for example 4 or 5) of belts or chains.

As also illustrated in FIGS. 2 and 3, condiments also can be dispensed in portions. In this embodiment, this storage unit is arranged beneath the conveyor belts 23 of storage unit 4 and is formed by a conveyor belt 81 with belts or chains circulating around end guide rollers. The conveying direction 82 of the conveyor belt 81 is opposite to the conveying direction 62 of the conveyors 23. The conveyor belt 81 shown in FIG. 3 comprises a plurality of transversely projecting webs 83, or arms, between which the condiment is accommodated.

A packed portion 84 of ketchup, for example, is added as condiment, preferably during the output of the heated portioned food items through the output opening of the dispensing station at output flap 72. The portion 84 passes from the conveyor belt 81, from which it falls under its own weight, into a chute 85 which crosses through the partition, or dividing wall, between the upper housing compartment 3 and the lower housing compartment 5 and opens at a removal opening 86 in the lower housing door 54 where the portion 84 can be removed. The switching on and displacement of the conveyor 81 are automatically controlled by the electronic control system present when a portioned food item for which a portion 84 is intended as condiment is selected by depression of the pushbutton.

After a selected portioned food item has been dispensed through the output opening 78, it passes onto an output shelf, preferably in the form of a chute 91 (FIG. 1), with an upwardly facing end web 92 on which the portioned food item stands and can be conveniently picked up. A depositing shelf 93 is preferably arranged laterally (in the present case as illustrated on the left) adjacent the output shelf arranged at one end and may extend over the entire front of the automatic dispenser 1 or the lower housing door 54. A serviette holder 94 and, optionally, also, a stand 95 for cardboard containers are preferably provided at that end of the depositing shelf 93 remote from the output shelf. Accordingly, the heated portioned food items which have been dispensed may be conveniently packed or even eaten on the depositing shelf 93.

Through the use of a tunnel oven 45, which accommodates several portions at a time, as the cooking unit and the generation of heat in accordance with the invention, a tasty heated food can be dispensed about every 20 seconds.

We claim:

1. An apparatus for dispensing heated portioned food items comprising:

a storage unit, for storing and providing portioned food items for dispensing, containing a plurality of endless conveyors, each having a horizontally disposed conveying surface, arranged one above another;

a cooking unit, for heating the portioned food items provided from the storage unit, including an endless conveyor having a horizontally disposed conveying surface for transporting the portioned food items through the cooking unit;

a transport lift unit, including an endless conveyor having a horizontally disposed conveying surface, for transferring the portioned food items from the storage unit conveyors to the conveying surface of the horizontally disposed cooking unit conveyor;

an output unit, including a dispensing station, an endless conveyor and a pivoting mechanism for pivoting the output unit conveyor horizontally through 90° for transfer of heated portioned food items from the cooking unit to the dispensing station, wherein the output unit conveyor has a horizontally disposed conveying surface for receiving the heated portioned food items from the cooking unit for transfer to the dispensing station for dispensing the heated portioned food items from the apparatus.

2. An apparatus according to claim 1 wherein the output unit further comprises a conveyor lift unit for transporting the heated portioned food items received from the cooking unit to the dispensing station.

3. An apparatus according to claim 2 wherein the transport lift unit includes a carriage which is associated with the transport lift unit conveyor and with guiderails, wherein the guiderails extend vertically from adjacent the cooking unit to and through the storage unit and in which the carriage and its associated conveyor are vertically displaceable for positioning the transport lift unit conveyor adjacent any one of the storage unit conveyors and adjacent the cooking unit conveyor for transferring food items from the conveying surface of a storage unit conveyor to the conveying surface of the cooking unit conveyor and wherein the output unit conveyor lift unit includes an output unit carriage which is associated with the output unit conveyor and with output unit guiderails, wherein the output unit guiderails extend vertically adjacent the dispensing station and the cooking unit, in which the output unit carriage and the output unit conveyor are vertically displaceable for positioning the output unit conveyor adjacent the cooking unit conveyor and adjacent the dispensing station for transferring heated food items from the conveying surface of the cooking unit conveyor and to the dispensing station.

4. An apparatus according to claim 1 or 2 wherein the cooking unit is a tunnel oven.

5. The apparatus according to claim 1 or 2 wherein the cooking unit is a microwave oven.

6. An apparatus according to claim 1 or 2 wherein the cooking unit is an infrared heater in combination with a microwave oven.

7. An apparatus according to claim 6 wherein the infrared heater is a light heater providing light radiation in the near range.

8. An apparatus according to claim 1 or 2 further comprising a further unit for storing and delivering condiments for dispensing.

9. An apparatus according to claim 8 wherein the further unit includes a further conveyor and a chute between the further conveyor and the dispensing station for dispensing the condiments.

10. An apparatus for dispensing heated portioned foot items comprising:

a storage unit, for storing and providing portioned food items for dispensing, containing a plurality of endless conveyors, each having a horizontally disposed conveying surface, arranged one above another;

a cooking unit, for heating the portioned food items provided from the storage unit, including a first opening at an input end of the cooking unit for entry of the portioned food items into the cooking unit and a second opening at an output end of the cooking unit for exit of heated portioned food items from the cooking unit and including an endless conveyor having a horizontally disposed conveying surface for transporting the portioned food items through the cooking unit from the input end to the output end;

a transport lift unit, including an endless conveyor having a horizontally disposed conveying surface, for transferring the portioned food items from the storage unit conveyors to the conveying surface of the horizontally disposed cooking unit conveyor;

an output unit, including a dispensing station, an endless conveyor and a pivoting mechanism for pivoting the output unit conveyor horizontally through 90° for transfer of the heated portioned food items to the dispensing station, wherein the output unit conveyor has a horizontally disposed conveying surface for receiving heated portioned food items from the output end of the cooking unit from the cooking unit conveyor for transfer to the dispensing station for dispensing the heated portioned food items from the apparatus.

11. An apparatus according to claim 10 wherein the cooking unit is a microwave oven.

12. An apparatus according to claim 10 further comprising a further unit for storing and delivering condiments for dispensing.

13. An apparatus according to claim 12 wherein the further unit includes a further conveyor and a chute between the further conveyor and the dispensing station for dispensing the condiments.

14. An apparatus according to claim 10 wherein the output unit further comprises a conveyor lift unit for transporting the heated portioned food items received from the cooking unit to the dispensing station.

15. An apparatus according to claim 14 wherein the cooking unit is a microwave oven.

16. An apparatus according to claim 14 wherein the dispensing station has a flap associated with an opening for dispensing the heated portioned food items which is locked in a closed position and is unlocked only during dispensing of a heated portioned food item.

17. An apparatus according to claim 16 wherein the output unit conveyor lift transport unit includes an actuating element for actuating unlocking and opening of the flap for dispensing of the heated portioned food items.

18. An apparatus according to claim 10 wherein the cooking unit is an infrared heater in combination with a microwave oven.

19. An apparatus according to claim 18 wherein the infrared heater is a light heater providing light radiation in the near range.

20. An apparatus according to claim 14 wherein the cooking unit is an infrared heater in combination with a microwave oven.

21. An apparatus according to claim 20 wherein the infrared heater is a light heater providing light radiation in the near range.

22. An apparatus according to claim 18 or 20 wherein a plurality of infrared radiation tubes associated with the infrared heater are arranged to extend substantially horizontally transversely of a direction of travel of the conveying surface of the cooking unit conveyor both above and below a throughput plane of the portioned food items being heated on the conveying surface of the cooking unit conveyor.

23. An apparatus according to claim 22 wherein the radiation tubes are grouped into two groups such that the tubes of one group are positioned in a first portion of the cooking unit adjacent the transport lift unit and generate a lower temperature than the radiation tubes of the second group which are positioned in a second portion of the cooking unit adjacent the output unit.

24. An apparatus according to claim 10 or 18 or 20 wherein a pivotal flap is associated with the first and second cooking unit openings for closing and opening each opening.

25. An apparatus according to claim 24 wherein the cooking unit is positioned beneath the storage unit and the entry opening flap is arranged for being opened by a downwardly directed pivoting movement about a horizontal axis and wherein the dispensing station is positioned beneath the cooking unit and the exit flap is arranged for being opened by an upwardly directed pivoting movement about a horizontal axis.

26. An apparatus according to claim 14 or 20 wherein the transport lift unit includes a carriage which is associated with the transport lift unit conveyor and with guiderails, wherein the guiderails extend vertically from adjacent the cooking unit to and through the storage unit and in which the carriage and its associated conveyor are vertically displaceable for positioning the transport lift unit conveyor adjacent any one of the storage unit conveyors and adjacent the cooking unit conveyor for transferring food items from the conveying surface of a storage unit conveyor to the conveying surface of the cooking unit conveyor.

27. An apparatus according to claim 26 wherein the output unit conveyor lift unit includes an output unit carriage which is associated with the output unit conveyor and with output unit guiderails, wherein the output unit guiderails extend vertically adjacent the dispensing station and the cooking unit and in which the output unit carriage and the output unit conveyor are vertically displaceable for positioning the output unit conveyor adjacent the cooking unit conveyor and adjacent the dispensing station for transferring heated food items from the conveying surface of the cooking unit conveyor to the dispensing station.

28. An apparatus according to claim 14 or 20 wherein the output unit conveyor lift unit includes an output unit carriage which is associated with the output unit conveyor and with output unit guiderails, wherein the output unit guiderails extend vertically adjacent the dispensing station and the cooking unit, in which the output unit carriage and the output unit conveyor are vertically displaceable for positioning the output unit conveyor adjacent the cooking unit conveyor and adjacent the dispensing station for transferring heated food items from the conveying surface of the cooking unit conveyor and to the dispensing station.

29. An apparatus according to claim 28 wherein the transport lift unit includes a transport lift unit carriage which is associated with the transport lift unit conveyor and with transport lift unit guiderails, wherein the transport lift unit guiderails extend vertically from adjacent the cooking unit to and through the storage unit and in which the transport lift unit carriage and its associated conveyor are vertically displaceable for positioning the transport lift unit conveyor adjacent any one of the storage unit conveyors and adjacent the cooking unit conveyor for transferring food items from the conveying surface of a storage unit conveyor to the conveying surface of the cooking unit conveyor.

30. An apparatus according to claims 10 or 20 wherein the transport lift unit includes a carriage which is associated with the transport lift unit conveyor and with guiderails, wherein the guiderails extend vertically from adjacent the cooking unit to and through the storage unit and in which the carriage and its associated conveyor are vertically displaceable for positioning the transport lift unit conveyor adjacent any one of the storage unit conveyors and adjacent the cooking unit conveyor for transferring food items from the conveying surface of a storage unit conveyor to the conveying surface of the cooking unit conveyor.

31. An apparatus according to claim 30 further comprising:

an output unit conveyor lift unit which includes an output unit carriage which is associated with the output unit conveyor and with output unit guiderails, wherein the output unit guiderails extend vertically adjacent the dispensing station and the cooking unit and in which the output unit carriage and the output unit conveyor are vertically displaceable for positioning the output unit conveyor adjacent the cooking unit conveyor and adjacent the dispensing station for transferring heated food items from the conveying surface of the cooking unit conveyor to the dispensing station.

32. An apparatus for dispensing heated portioned food items comprising a storage unit, for storing and providing portioned food items for dispensing, containing a plurality of endless conveyors, each having a horizontally disposed conveying surface, arranged one above another;

a cooking unit, for heating the portioned food items provided from the storage unit, including a combination of a microwave oven and an infrared heater having a first opening at an output end of the cooking unit for entry of the portioned food items into the cooking unit and a second opening at an output end of the cooking unit for exit of heated portioned food items from the cooking unit and including an endless conveyor having a horizontally disposed conveying surface for transporting the portioned food items through the cooking unit from the input end to the output end;

a transport lift unit, including an endless conveyor having a horizontally disposed conveying surface; for transferring the portioned food items from the storage unit conveyors to the conveying surface of the horizontally disposed cooking unit conveyor;

an output unit, including a dispensing station, an endless conveyor and a pivoting mechanism for pivoting the output unit conveyor horizontally through 90° for transfer of the heated portion food items to the dispensing station, wherein the output unit conveyor has a horizontally disposed conveying surface for receiving heated portioned food items from the cooking unit for transfer to the dispensing station for dispensing the heated portioned food items from the apparatus.

33. An apparatus according to claim 32 wherein the infrared heater is a light heater providing light radiation in the near range.

34. An apparatus according to claim 32 wherein a plurality of infrared radiation tubes associated with the infrared heater are arranged to extend substantially horizontally transversely of a direction of travel of the conveying surface of the cooking unit conveyor both above and below a throughput plane of the portioned food items being heated on the conveying surface of the cooking unit conveyor.

35. An apparatus according to claim 32 wherein the cooking unit is a tunnel oven.

36. An apparatus according to claim 32 wherein the output unit further comprises a conveyor lift unit for transporting the heated portioned food items received from the cooking unit to the dispensing station.

37. An apparatus according to claim 36 wherein the transport lift unit includes a transport lift unit carriage which is associated with the transport lift unit conveyor and with transport lift unit guiderails, wherein the transport lift unit guiderails extend vertically from adjacent the cooking unit to and through the storage unit and in which the transport lift unit carriage and its associated conveyor are vertically displaceable for positioning the transport lift unit conveyor adjacent any one of the storage unit conveyors and adjacent the cooking unit conveyor for transferring food items from the conveying surface of a storage unit conveyor to the conveying surface of the cooking unit conveyor and wherein the output unit conveyor lift unit includes an output unit carriage which is associated with the output unit conveyor and with output unit guiderails, wherein the output unit guiderails extend vertically adjacent the dispensing station and the cooking unit and in which the output unit carriage and the output unit conveyor are vertically displaceable for positioning the output unit conveyor adjacent the cooking unit conveyor and adjacent the dispensing station for transferring heated food items from the conveying surface of the cooking unit conveyor to the dispensing station.

38. An apparatus according to claim 32 further comprising a further unit for storing and delivering condiments for dispensing.

39. An apparatus according to claim 38 wherein the further unit includes a further conveyor and a chute between the further conveyor and the dispensing station for dispensing the condiments.

* * * * *

UNITED STATES PATENT AND TRADEMARK OFFICE

CERTIFICATE OF CORRECTION

PATENT NO. : 5,048,719

DATED : September 17, 1991

INVENTOR(S) : Franz EMPL, et al.

It is certified that error appears in the above-identified patent and that said Letters Patent is hereby corrected as shown below:

Column 8, line 21 (line 1 of claim 5), "The" should be --An--.

Column 10, line 11 (line 1 of claim 27), "wherein the " should be --further comprising an--.

Column 10, line 12 (line 2 of claim 27), after "unit" (2nd occurrence) insert --which--.

Signed and Sealed this

Twenty-second Day of December, 1992

*Attest:*

DOUGLAS B. COMER

*Attesting Officer*

*Acting Commissioner of Patents and Trademarks*